US007114528B2

(12) United States Patent
Schmid et al.

(10) Patent No.: US 7,114,528 B2
(45) Date of Patent: Oct. 3, 2006

(54) HEALD SHAFT OF COMPOSITE CONSTRUCTION

(75) Inventors: Thomas Schmid, Weilstetten (DE); Bernd Binder, Albstadt (DE); Johannes Bruske, Albstadt (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 10/968,019

(22) Filed: Oct. 20, 2004

(65) Prior Publication Data

US 2005/0081941 A1 Apr. 21, 2005

(30) Foreign Application Priority Data

Oct. 21, 2003 (DE) ..... 103 49 382

(51) Int. Cl.
*D03C 9/06* (2006.01)

(52) U.S. Cl. ..... 139/92; 139/91

(58) Field of Classification Search ..... 139/91, 139/92

See application file for complete search history.

(56) References Cited

U.S. PATENT DOCUMENTS

| | | | | | |
|---|---|---|---|---|---|
| 3,754,577 | A * | 8/1973 | Heller | 139/92 |
| 3,948,296 | A * | 4/1976 | Koch | 139/91 |
| 4,144,910 | A * | 3/1979 | Bader | 139/91 |
| 4,390,045 | A | 6/1983 | Baumann | |
| 4,633,916 | A | 1/1987 | Rast | |
| 4,901,767 | A * | 2/1990 | Koch | 139/92 |
| 4,913,193 | A | 4/1990 | Faasse | |
| 4,913,194 | A * | 4/1990 | Kramer | 139/91 |
| 5,183,082 | A * | 2/1993 | Baumann | 139/92 |
| 5,249,605 | A * | 10/1993 | Graf | 139/91 |
| 5,280,810 | A * | 1/1994 | Shimizu | 139/91 |
| 6,446,676 | B1 * | 9/2002 | Magri et al. | 139/92 |
| 2003/0079793 | A1 | 5/2003 | Mettler | |

FOREIGN PATENT DOCUMENTS

| | | |
|---|---|---|
| DE | 69 29 985 | 11/1974 |
| DE | 25 23 321 A1 | 12/1976 |
| DE | 29 43 953 C2 | 4/1983 |
| DE | 36 21 145 A1 | 1/1987 |
| DE | 39 37 657 A1 | 6/1990 |

* cited by examiner

*Primary Examiner*—John J. Calvert
*Assistant Examiner*—Robert H Muromoto
(74) *Attorney, Agent, or Firm*—Fitch, Even, Tabin & Flannery; Norman N. Kunitz

(57) ABSTRACT

A heald shaft for weaving machine has a shaft rod (3) which is formed of a one-piece light-metal profile and two stiffening bodies (24, 25) glued to the shaft rod (3). The stiffening bodies bridge the entire width of the shaft rod (3), wherein the width is measured between the side walls (11, 12). The chambers 14, 16 for receiving the stiffening bodies (24, 25) each have at least one open side through which the stiffening body is visible from the outside and through which it may be introduced into the respective chamber (14, 16). This construction facilitates manufacture. Further, a rigidity in the working direction, as well as a good rigidity transversely thereto is achieved.

19 Claims, 7 Drawing Sheets

HEALD SHAFT OF COMPOSITE CONSTRUCTION

CROSS REFERENCE TO RELATED APPLICATION

This application claims the priority of German Patent Application No. 103 49 382.4, filed on Oct. 21, 2003, the subject matter of which, in its entirety, is incorporated herein by reference.

FIELD OF THE INVENTION

The invention relates to a heald shaft for weaving machines, particularly for rapidly operating weaving machines.

BACKGROUND OF THE INVENTION

The shafts of weaving machines are moved very rapidly during weaving and are induced to oscillate. This applies generally, but it may lead to particular problems in case of long shafts (wide fabrics). The shaft oscillations are generated both parallel and transversely to the longitudinal direction of their motion. The oscillations lead to stresses on the heald shaft, the healds, the heald staves and the warp treads. The stresses may cause premature heald breakage, shaft breakage or other defects.

It has already been repeatedly attempted, on the one hand, to reduce the weight of the shaft rods to lessen the generation of oscillation and, on the other hand, to increase the rigidity of the shaft rods. These efforts have resulted in improved shaft rods, while, as before, the purpose of further development has been to increase the obtained limits for the working speed of the weaving machine and to improve the accuracy of thread guidance, that is, as an ultimate goal, to reduce the amplitude of the bending oscillations of the shaft rods.

The tendency of the shaft rods to oscillate significantly contributes to the noise generation and wear of the weaving machines. Also, as concerns noise reduction, it is a purpose in developing heald shafts to reduce their tendency to oscillate.

German Patent Document No. 29 43 953 C2 describes a heald shaft rod having a light-metal, hollow-chamber profile. The heald shaft rod has two flat side walls which enclose several hollow chambers. One of the side walls is glued to a steel band extending almost along the entire height of the side wall for the purpose of reducing oscillations of the shaft rod to thus diminish the generated sound intensity.

Possibilities concerning a damping of oscillations are explored for the purpose of surpassing the effectiveness of the above-outlined measure.

German Patent Document No. 39 37 657 A1 discloses a shaft rod which is formed by a two-part profiled aluminum body. The two aluminum profiles together enclose a total of three hollow chambers, of which one chamber is filled with a foam body and the other two chambers are filled with a synthetic carbon fiber body. The synthetic carbon fiber bodies have an approximately rectangular cross section which entirely fills the respective hollow chamber. The synthetic carbon fiber bodies are glued by means of an epoxy resin adhesive to the two side walls of the hollow chamber profile and to the contacting webs thereof.

The positioning of the synthetic carbon fiber bodies in chambers which are closed on all sides and which are formed between the two mutually fitting aluminum profiles requires an accurate fit between the two aluminum profiles themselves and the synthetic carbon fiber parts. This requirement constitutes a significant manufacturing difficulty. Furthermore, the shaft rod has an appreciable weight.

A shaft rod also provided with an integrated stiffening is known from German Patent Document No. 36 21 145 A1. The shaft rod is formed by two elongated, mutually fitting parts which together close an inner space filled with a stiffening element and a honeycomb element. The stiffening element is formed by a carbon fiber body.

The positioning of the carbon fiber body into the closed inner space involves not only manufacturing difficulties, but also leads to a significant weight of the shaft.

U.S. Pat. No. 3,754,577 describes a shaft rod formed as a hollow-chamber profile. According to one of the embodiments the shaft rod is, at its upper edges as well as at its lower edges, provided with apertures into which stiffening elements of rectangular cross section are glued. While the hollow-chamber profile is of aluminum, the stiffening elements are made of a fiber glass reinforced synthetic material.

Shaft rods of the above-outlined construction have an increased stiffness with respect to stresses which act in the directions of motion, that is, parallel to the side walls of the profiled body. Oscillations which are transverse to the shaft profile, however, are damped to a lesser degree. In this respect a shaft rod of such a construction too, is considered to be in the need of improvement. Such considerations also apply to German Utility Model No. G 69 29 985 which discloses a similar shaft rod.

Accordingly, it is an object of the invention to provide a heald shaft, particularly for rapidly operating weaving machines, which has a greater dynamic stiffness and better oscillating properties than prior art constructions.

SUMMARY OF THE INVENTION

The above object is achieved with a heald shaft according to the invention that has at least one shaft rod formed as a composite profile. The shaft rod comprises an elongated, hollow-profile base body which supports two stiffening bodies. The hollow-profile body is formed, for example, of a light-metal profile body, such as an extrusion-molded aluminum profile member, whereas the stiffening bodies are preferably synthetic carbon fiber bars. The particularity of the shaft bar resides in the arrangement of the stiffening bodies. Thus, the stiffening bodies are disposed in open chambers, into which they may be introduced laterally. For this purpose each chamber has an open side, that is, a lateral opening of appropriate size. In this manner, on the one hand, unnecessary material is removed from the base body, thus reducing its weight and, on the other hand, a manufacture of the base body as a one-piece component is feasible which, in turn, enhances its stiffness. The base body has at least one, but preferably several webs which connect the side walls of the hollow-chamber profile with one another. The stiffening body either lies against such a web and is attached (for example, glued) thereto, or it bridges the distance between the side walls in an overhanging manner. It is also feasible to provide that one of the stiffening bodies is disposed in an open chamber in engagement with a web, while the other stiffening body lies against a web portion solely with its ends. Such an arrangement results in a superior stiffening of the shaft rod while, at the same time, the weight of the shaft rod is reduced. The shaft rod according to the invention makes possible higher operating speeds of the weaving machine and shows a reduced tendency to oscillate.

According to a preferred embodiment at least one of the stiffening bodies, preferably the upper stiffening body, does not extend over the entire length of the shaft rod, but only along a part thereof. By virtue of such an arrangement the end zones of the respective hollow chamber are free, so that corner connectors may be used which serve, for example, for attaching the end binders. The introduction of forces into the ends of the shaft rod is thus effected through the base body made of aluminum or other metal, for example, over the entire height of the respective side wall of the utilized hollow chamber. The stiffening body does not take away any space from the corner connector, so that the latter may use the entire chamber cross section.

By providing for a lateral introduction of the stiffening body into the respective hollow space, the stiffening body may be introduced in a short path into the respective chamber of the shaft rod substantially simultaneously along its entire length. This circumstance significantly facilitates the manufacture of uniform adhesive gaps as compared to an axial introduction of a stiffening body into a hollow space. As a result, a high-quality adhesive bond is made possible which, in turn, ensures a good force transmission between the stiffening body and the light-metal base body. The good force transmission achieved causes high rigidity and high resistancy to oscillations.

According to a preferred embodiment side wall parts which border the chamber that receives the stiffening body, are removed, so that the stiffening body projects, with a large portion of its length, beyond the hollow-chamber profile. Only the ends of the stiffening body and a lower portion thereof are situated within the base body. In such an embodiment, having a largely freely disposed stiffening body, very high rigidity values are obtained at a reduced mass.

The stiffening body may be attached at its end, for example, to a web portion and/or a side wall portion. Such an arrangement is particularly advantageous as concerns the introduction of pulling forces into the stiffening body.

Further details of advantageous embodiments are shown in the drawing, the description, and the claims.

DETAILED DESCRIPTION OF THE INVENTION

Figure 1:
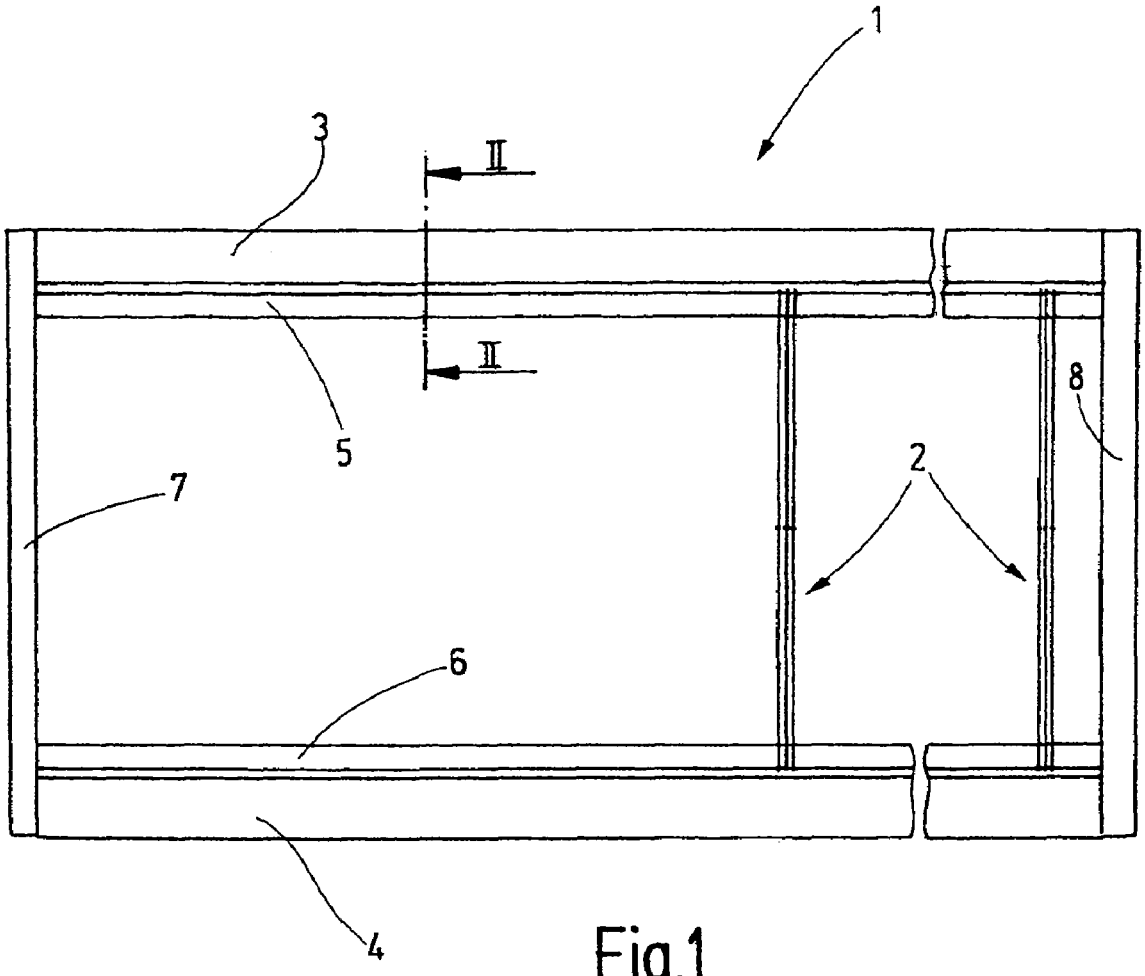
FIG. 1 schematically shows a heald shaft.

FIG. 1 illustrates a heald shaft 1 which, together with its healds 2, guides warp threads in a weaving machine (not shown) out of a warp yarn plane upward or downward to present a shed for introducing weft yarns. The heald shaft comprises an upper and a lower shaft rod 3 and 4, respectively, which are each provided with a respective shaft stave 5, 6. The healds 2 are held on the shaft staves 5, 6 by their respective terminal eyelets with a slight vertical play. The shaft rods 3 and 4 which may be of identical construction, are connected to one another at their ends by end binders 7, 8. The following description of different embodiments of the shaft rod 3 therefore equally applies to the shaft rod 4.

Figure 2:
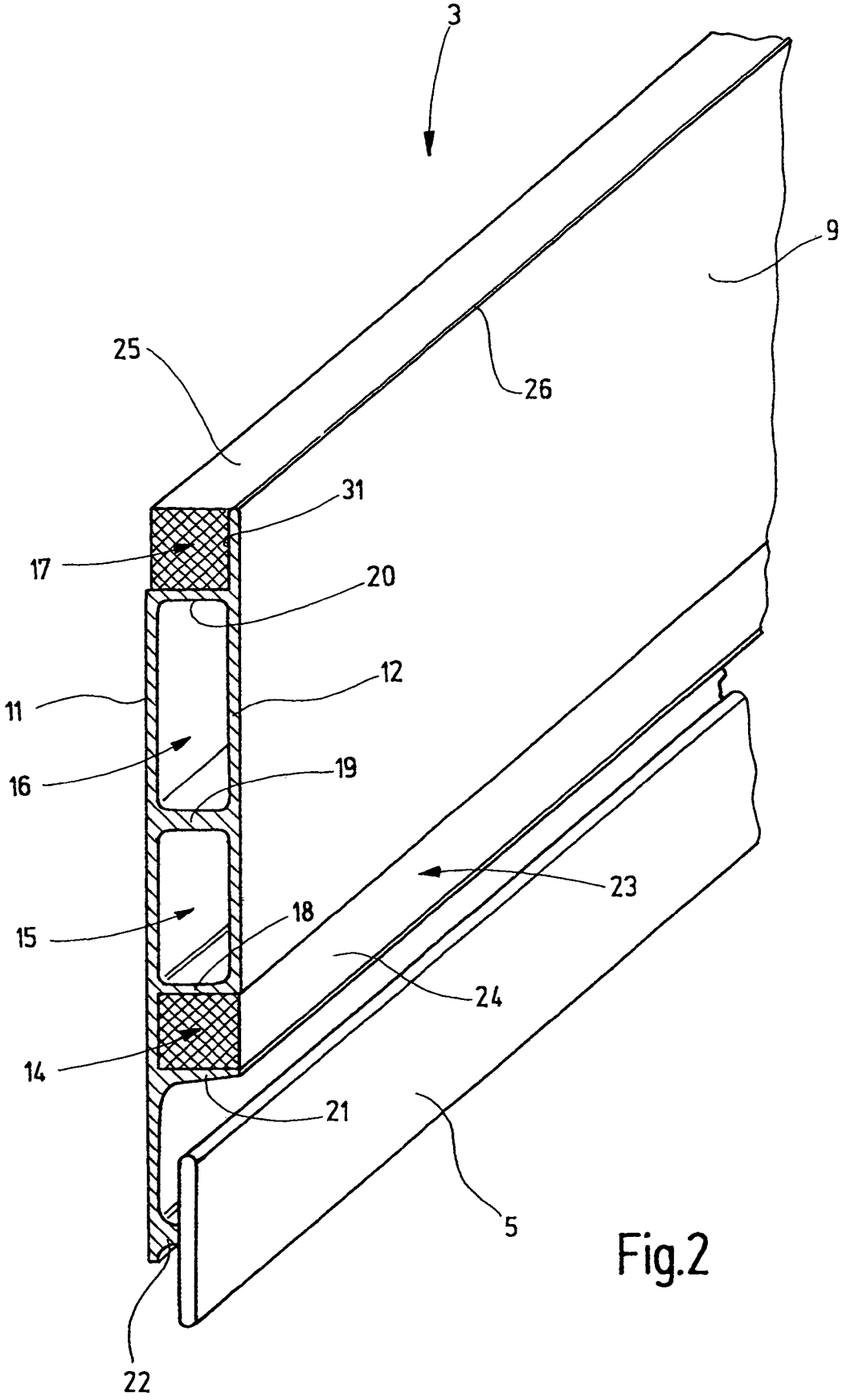
FIG. 2 is a fragmentary, perspective, sectional illustration of a shaft rod of the heald shaft according to FIG. 1.

The shaft rod 3 which is separately shown in FIG. 2, has an elongated base body 9 formed of a hollow profile body which may be, for example, a one-piece light-metal body, such as a profiled aluminum component made by extrusion molding. The base body 9 has two substantially planar side walls 11, 12 which extend parallel to and spaced from, one another and which constitute the flat sides of the shaft rod 3. The base body 9 includes two, but preferably more chambers 14, 15, 16, 17 which are separated from one another by webs 18, 19, 20. The webs extend in the longitudinal direction along the shaft rod 3 and are oriented parallel to one another and preferably perpendicularly to the side walls 11, 12. The side wall 11 is prolonged beyond a web 21 bordering the chamber 14 from below and carries the shaft stave 5 at a holding rib 22. The chamber 14 bounded by the webs 18, 21 and the side wall 11 is laterally open, preferably along its entire height measured as the distance between the webs 18, 21. The chamber 14 has slot-like opening 23 which extends along the entire length of the shaft rod 3 and whose opening direction is oriented perpendicularly to the side wall 12.

In the chamber 14 a stiffening body 24 is disposed, whose cross section approximately corresponds to that of the chamber 14. The stiffening body 14 is preferably a carbon fiber reinforced synthetic body having a square or rectangular cross section and having a length identical to the length of the base body 9. The stiffening body 24 is glued to the base body 9 at least at its ends, but preferably along its entire length. The adhesive bond is preferably present on three surfaces: the stiffening body 24 is glued to the web 18, the side wall 11 and the web 21. Preferably an adhesive gap between 0.1 and 0.3 mm is provided. For maintaining the dimensions of the adhesive clearance, projections, preferably ribs, may be provided at the stiffening body 24 and/or at the base body surfaces facing the stiffening body 24. The dimensions of the ribs correspond to that of the adhesive gap and extend parallel to the base body 9 along the entire length of the adhesion surface. It is also feasible to mix the adhesive with spacers, such as small glass beads of essentially uniform size, which then determine the minimum thickness of the adhesive gap.

According to a modified embodiment, the stiffening body is glued only to the web 18 and the web 21, but not to the side wall 11. The webs 18, 21 which are interconnected by the stiffening body 24, are exposed to tension and pressure in case of an oscillation load on the shaft rod 3. Their own thickness is significantly less than that of the web 19. The unit composed of the webs 18, 21 and the stiffening body 24 is, however, substantially thicker in its totality than the web 19.

Figure 3:
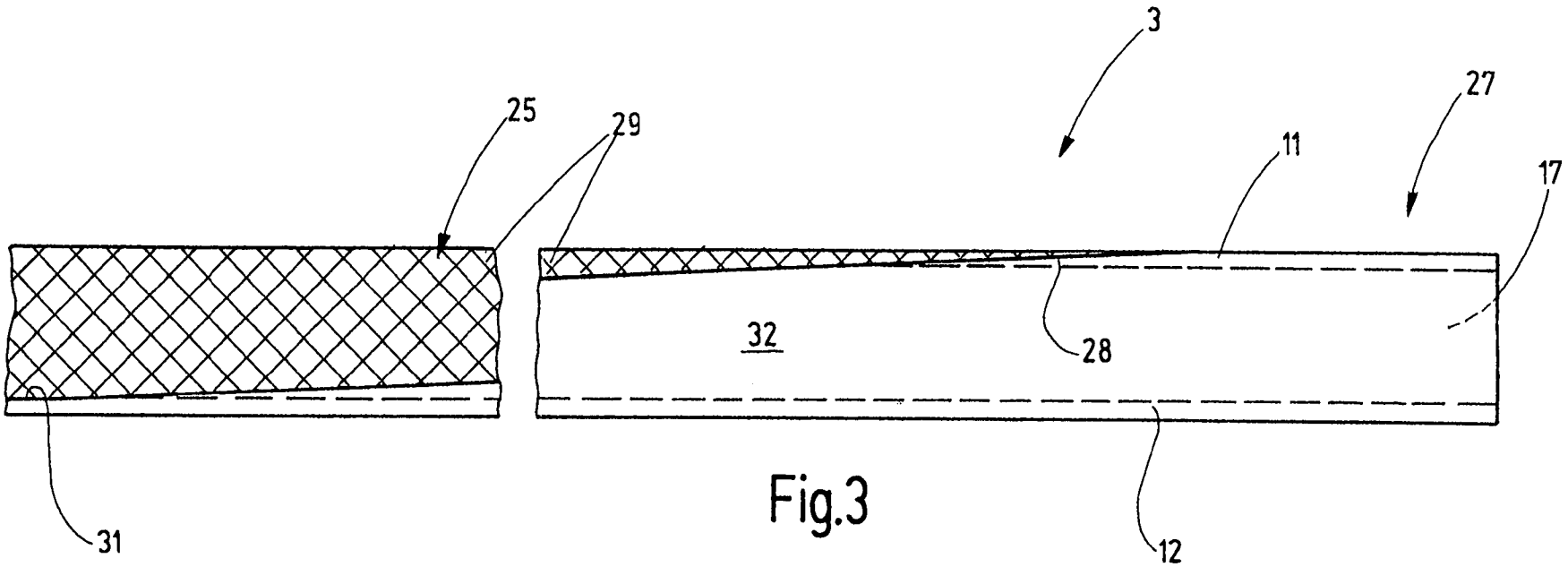
FIG. 3 is a fragmentary top plan view of the shaft rod shown in FIG. 2.

The chambers 15, 16 are preferably empty, but may contain an appropriate filling material in certain applications. The chamber 17 is provided with a further stiffening body 25 which again is a carbon fiber reinforced synthetic body and has a square or rectangular cross section. Differently from the chamber 14 which is closed on three sides and is open solely on one side, the chamber 17 is preferably significantly more open; on two sides it is bounded by the side wall 12 and by the web 20, respectively, and is open on the top. No web or the like adjoins the upper edge 26 of the chamber 17. As an option, however, such a web may be provided at end regions 27 of the shaft rod 3 as a part of the contour of the extruded profile forming the base body 9. An end region 27 in which such a web is present extends from the end of the stiffening body 25 to the end of the shaft rod 3. The stiffening body 25 preferably does not extend over the entire length of the shaft rod 3, as shown, for example, in FIG. 3. In the end region 27 of the shaft rod 3 the chamber 17 is closed; it is formed by the webs 20, 32 and the side walls 11, 12. The side wall 11 extends up to the same height as the side wall 12. In these end regions the chamber 17 is preferably empty. The web 32 and the side wall 11 run out in the direction of the stiffening body 25 into a wedge portion 28 and render the chamber 17 laterally free. Between he terminal remainders of the side wall 11 in the zone of the stiffening body 25, the chamber 17 is thus not only upward, but also laterally open.

Correspondingly, the stiffening body 25 has a wedge-shaped end portion 29, whose wedge angle is identical to the wedge angle of the wedge portion 28. The wedge angle is preferably between 1°–5° and is advantageously 2°–3°. The stiffening body 25 is glued to the base body 9 and is, in particular, attached at its underside to the web 20 and to the side wall 12 at its side facing the side wall 12. Further, the terminus of its end portion 29 is glued to the wedge portion 28 of the web 32 and the side wall 11. By virtue of such an arrangement the chamber 17 is in the end regions of the shaft rod 3 utilized for stiffening the shaft rod to resist an upward bending which leads to a tension stress at the stiffening body 25.

As shown, the end portion 29 may be wedge-shaped throughout, or may have one or more steps. At its side adjoining the side wall 11 the end portion 29 has a length which differs from the length of its lateral surface 31 adjoining the side wall 12. By an appropriate dimensioning of the length difference, the generation of oscillations in the shaft rod 3 in the lateral direction (perpendicularly to the side surfaces 11, 12) based on an oscillation stress in the vertical direction (parallel to the side surfaces 11, 12) may be regulated and set as desired.

The chambers 15, 16 and, if required, the chamber 17 may serve for receiving corner connecting pieces which are adjoined by the end binders 7, 8. The introduction of forces emanating from the end binders 7, 8 into the base body 9 thus occurs at the ends of the shaft rod 3.

The heald shaft 1 described so far is exposed to relative high bending stresses during operation. The driving forces are introduced into the ends of the shaft rod 3 through the end binders 7, 8. The healds and thus also the warp threads are suspended from the heald stave 5. Because of the weight of the healds and the warp threads and because of the acceleration forces generated during the upward and downward motion, significant vertical forces oriented parallel to the end binders 7, 8 are imparted to the heald stave 5. Such vertical forces lead to a bending stress on the shaft rod 3. The bending stress manifests itself as a tensile and pressure stress for the stiffening bodies 24, 25. The web 19 is preferably arranged in the neutral axis, so that it is not exposed to either a tensile stress or a pressure stress. The tensile and pressure stresses are transmitted to the stiffening bodies 24, 25 by the respective adhesive gaps. In this construction particularly the bond with the webs 18, 20 is force-transmitting. The force introduction into the stiffening bodies 24, 25 is effected preferably symmetrically. The additional asymmetrical connection of the stiffening body 24 with the side wall 11 and the stiffening body 25 with the side wall 12 may be specifically utilized for further oscillation compensation, particularly for extinguishing oscillations along the length of the warp thread direction.

Figure 4:
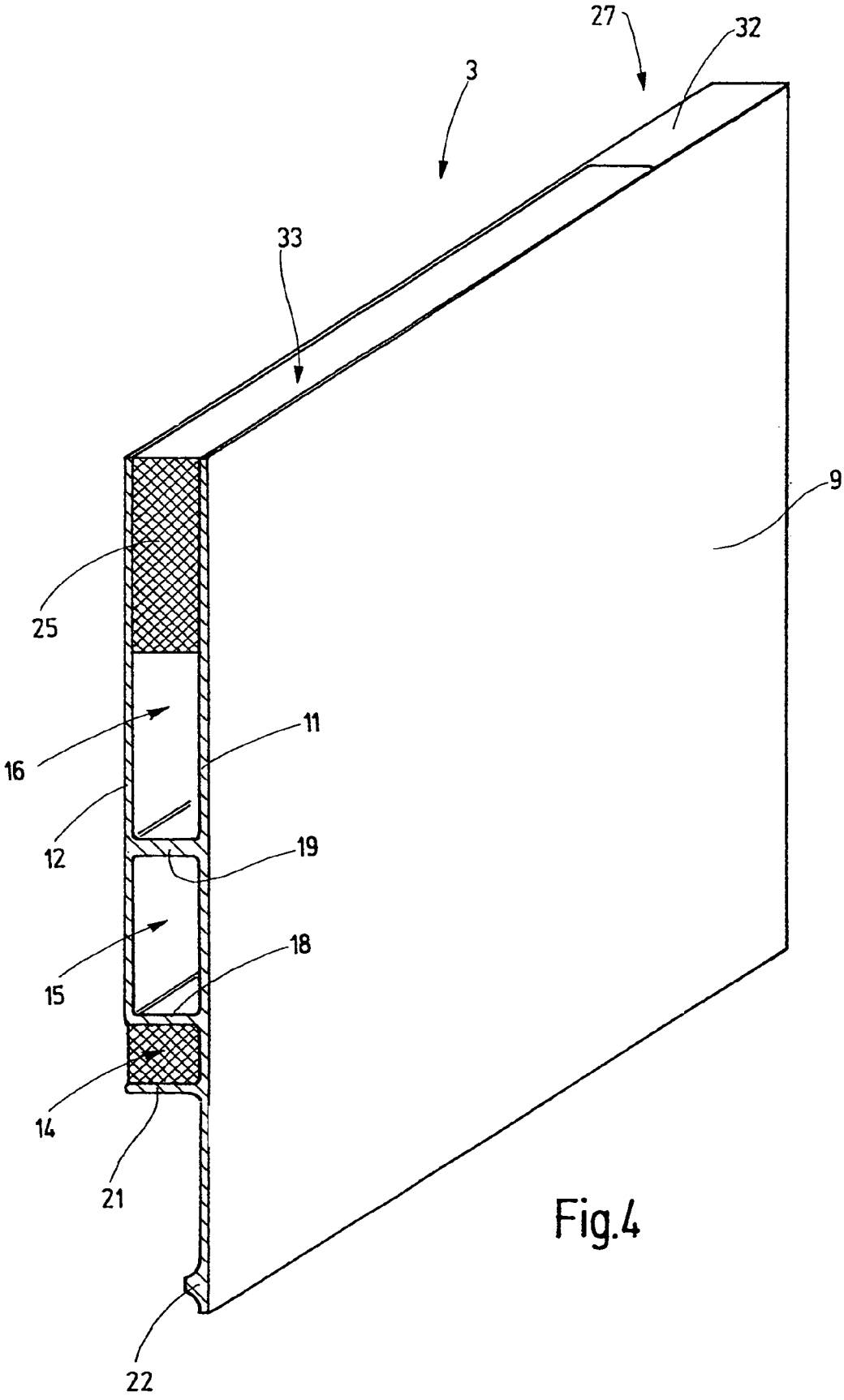
FIG. 4 is a perspective, sectional partial illustration of a modified embodiment of a shaft rod for a heald shaft of FIG. 1.
Figure 5:
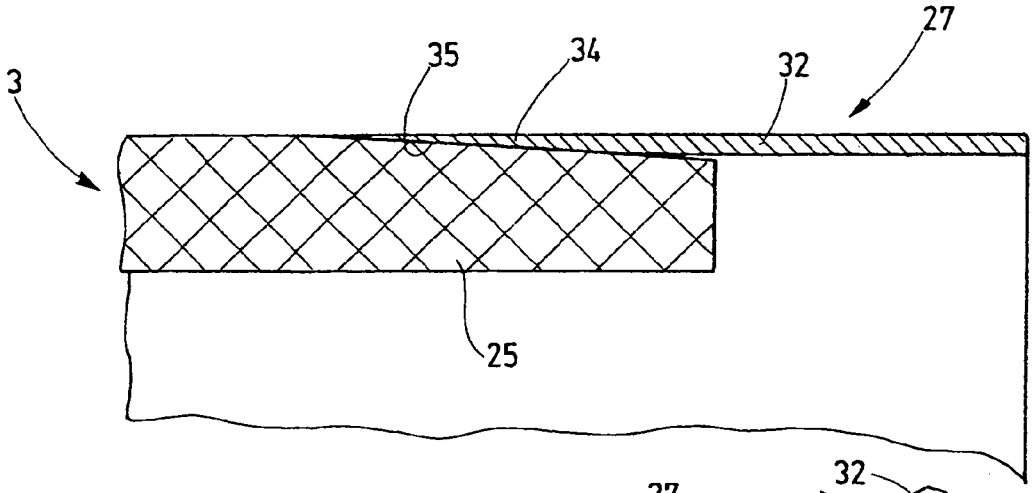
FIG. 5 is a fragmentary longitudinal sectional view of the shaft rod of FIG. 4.

FIG. 4 illustrates a modified embodiment of the shaft rod 3. To the extent the same reference numerals are used, reference is made to the foregoing description. The following complementation is supplied:

The web 20 of the earlier described embodiment is omitted in its entirety from the structure of FIG. 4; that is, the chamber 16 extends from the web 19 to a web 32 provided at the upper side of the shaft rod 3. The web 32 is oriented perpendicularly to the side surfaces 11, 12 and is present only in the end region 27 of the shaft rod 3, otherwise it is removed, for example, by a subsequent chip-breaking machining of the base body 9. As a result, the chamber 16 is upward open along its entire width and has a rectangular, slot-like opening 33. As shown in FIG. 5, the web 32 which is a one-piece part with the side walls 11, 12, is preferably provided at its end with a wedge portion 34. The stiffening body 25 is bonded to the wedge portion 34 by an adhesive joint 35 formed as a wedge-shaped portion at the end of the stiffening body 25. Further, the stiffening body 25 is glued at its flanks to the side walls 11, 12, for example, continuously along the entire length. In some instances, however, it is sufficient to bond the stiffening body 25 solely at its ends with the wedge portion 34 and with the side walls 11, 12. Also, if needed, additional bonding locations may be distributed along its entire length.

Such a shaft rod has a particularly high degree of rigidity.

Figure 6:
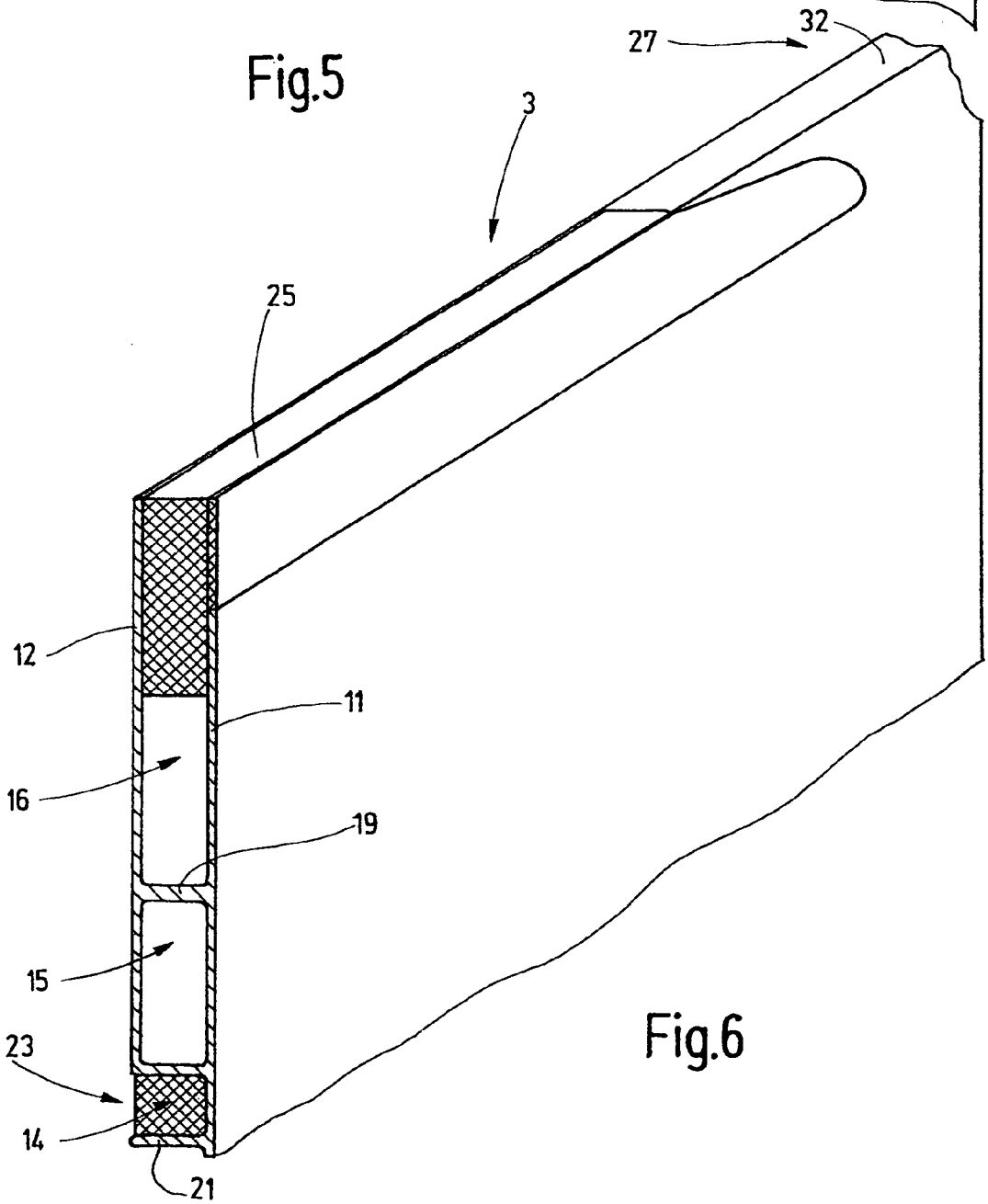
FIG. 6 is a fragmentary, perspective, sectional illustration of a modified embodiment of a shaft rod for a heald shaft of FIG. 1.
Figure 7:
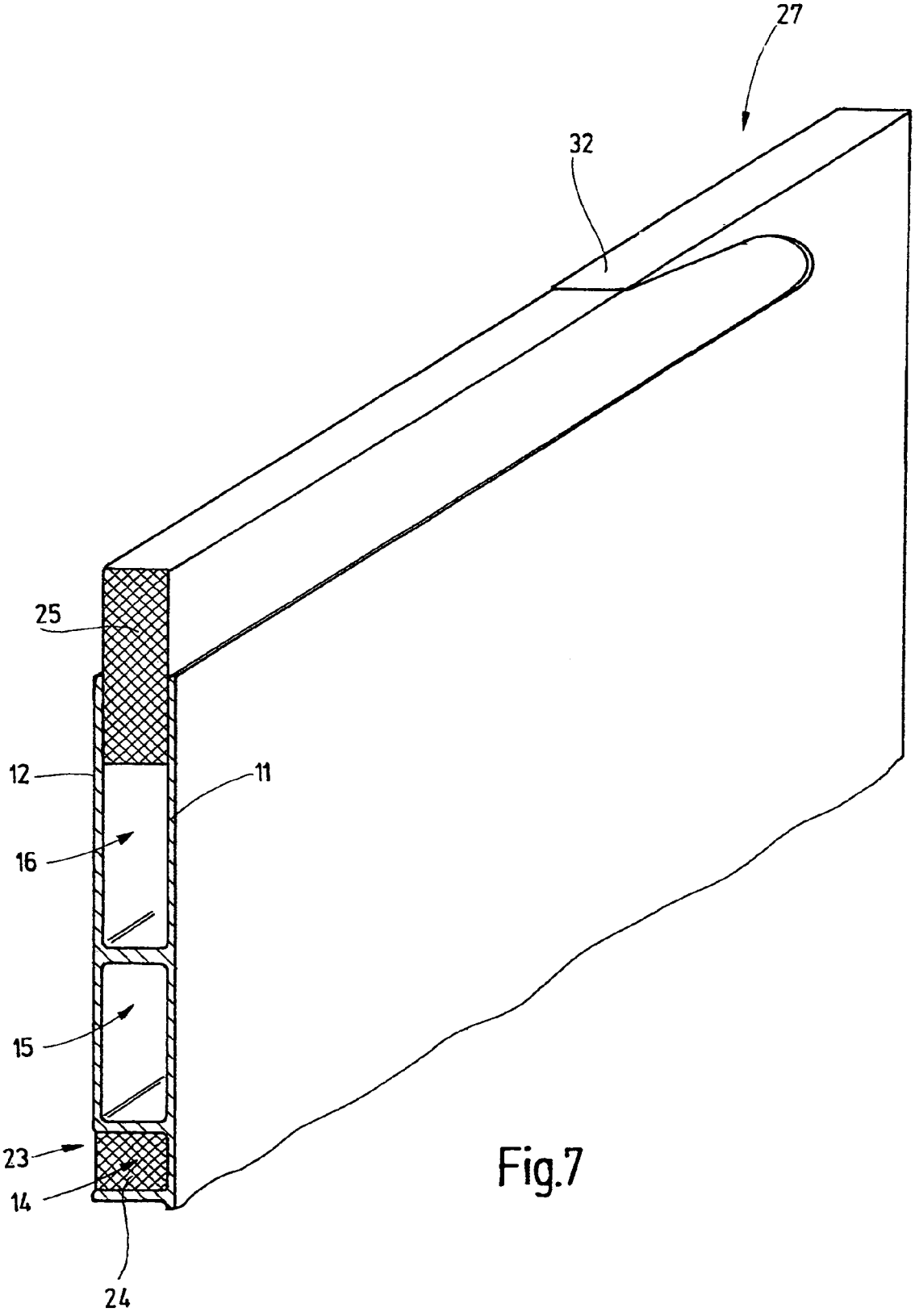
FIG. 7 is a fragmentary, perspective, sectional illustration of a further embodiment of a shaft rod for a heald shaft of FIG. 1.

FIG. 6 illustrates a further modified embodiment of the shaft rod 3, based essentially on the embodiment shown in FIG. 4. The following is noted additionally as concerns these embodiments:

Similarly to the shaft rod 3 according to FIG. 4, the shaft rod 3 according to FIG. 6 has only three chambers 14, 15, 16, wherein the chamber 16 accommodates the upper stiffening body 25. The upper side wall 11 is present only in the end region 27, otherwise it is removed approximately up to one half the height of the stiffening body 25. Such a construction results in a weight reduction of the shaft rod 3 without any appreciable or relevant reduction in its rigidity. By virtue of the asymmetry between the side walls 11, 12 in the upper end region, the generation of oscillations in the length direction of the warp threads may be controlled and minimized. It is further feasible to shorten both side walls 11, 12 externally of the end region 27, as illustrated in FIG. 7. As shown, the side walls 11, 12 may terminate at the same height, or at different heights. Similarly to the embodiment shown in FIG. 6, however, the upper chamber 16 is closed in the end region 27. The web 32 as well as the side walls 11, 12 are present in the end region 27 in their entirety. The web 32 forms a wedge-shaped overhanging tongue oriented parallel to the web 19 and runs onto the stiffening body 25, so that the web 32 is enclosed in its end region. The corner connecting parts introduced into the chamber 16 and coupled to the end binders 7, 8 thus have four chamber walls for support and engagement. This construction provides overall a shaft rod which is of simple and clear design and which has a relatively light weight and a high degree of rigidity and which further may be manufactured with reliable processes.

Figure 8:
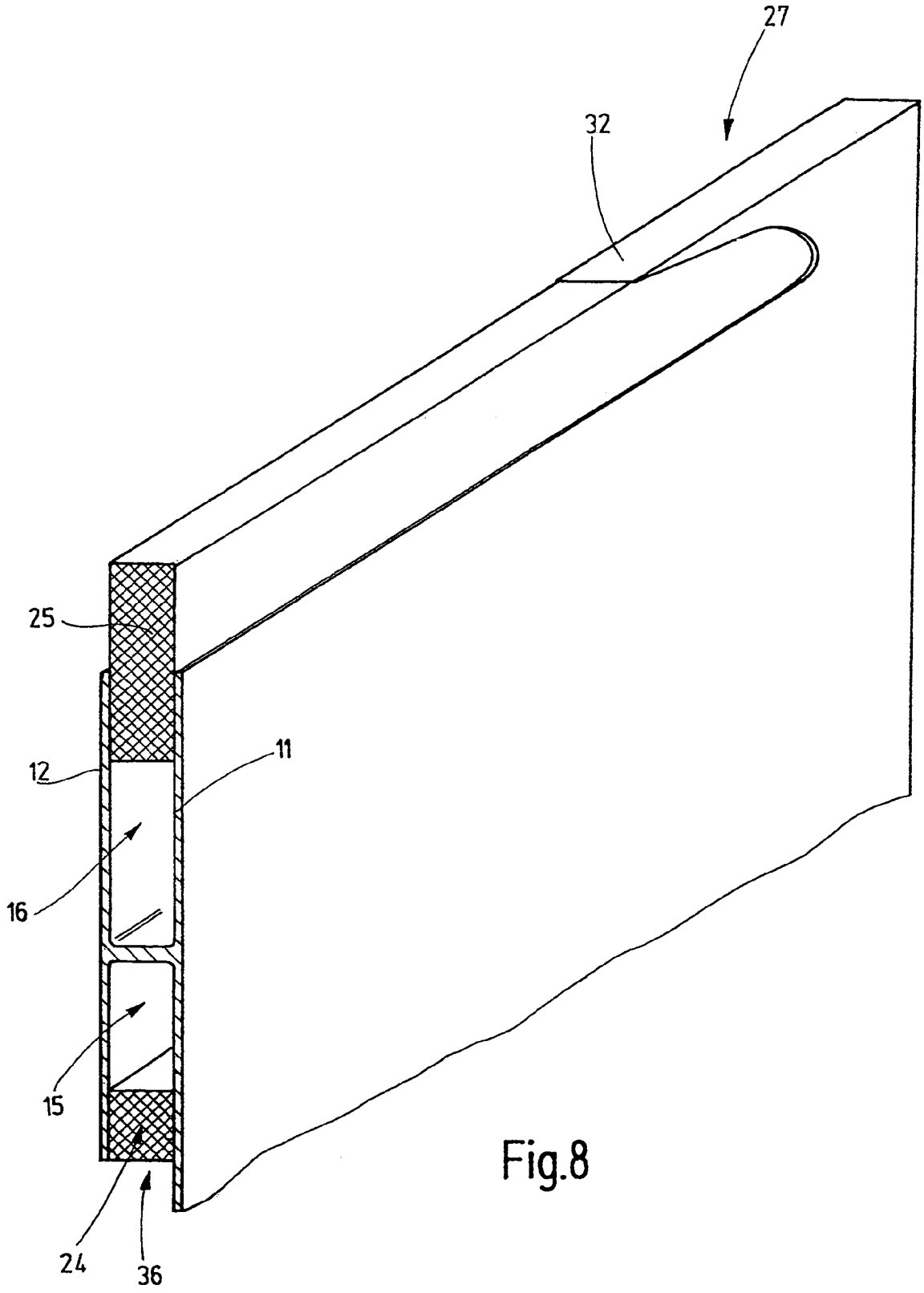
FIG. 8 is a fragmentary, perspective, sectional illustration of a further modified embodiment of a shaft rod for a heald shaft of FIG. 1.

A further modified embodiment of the invention is illustrated in FIG. 8. As a departure from the earlier-described embodiments of the shaft rod 3, in the embodiment of FIG.

8 the chamber 15 serves for accommodating the stiffening body 24. The chamber 15 is open downward by means of an opening 36.

A heald shaft for a weaving machine has a shaft rod 3 which is formed of a one-piece light-metal profile and two stiffening bodies 24, 25 glued to the shaft rod 3. The stiffening bodies bridge the entire width of the shaft rod 3, the width being measured between the side walls 11, 12. The chambers 14, 16 for receiving the stiffening bodies 24, 25 each have at least one open side through which the stiffening body is visible from the outside and through which it may be introduced into respective chamber 14, 16. This construction facilitates manufacture. Further, a rigidity in the working direction, as well as a good rigidity transversely thereto is achieved.

It will be appreciated that the above description of the present invention is susceptible to various modifications, changes and adaptations, and the same are intended to be comprehended within the meaning and range of equivalents of the appended claims.

LIST OF REFERENCE NUMERALS

1 heald shaft
2 healds
3, 4 shaft rods
5, 6 shaft staves
7, 8 end binders
9 base body
11, 12 side walls
14, 15, 16, 17 chambers
18, 19, 20 webs
21 web
22 holding rib
23 opening
24, 25 stiffening bodies
26 edge
27 end region
28 wedge portion
29 end portion
31 lateral surface
32 web
33 opening
34 wedge portion
35 adhesive joint
36 opening

What is claimed is:

1. A heald shaft for weaving machines, particularly for rapidly operating weaving machines, comprising an elongated base body formed as a hollow profile body and having two side walls which are interconnected by a web; the base body further having at least one first chamber and at least one second chamber, each being open at least at one side, a first stiffening body occupying the entire width of the base body between the two sidewalls and being disposed in the first chamber; the first stiffening body being glued at least at two sides to the base body, and a second stiffening body occupying the entire width of the base body between the two side walls and being disposed in the second chamber; the second stiffening body being glued at least at two sides to the base body.

2. The heald shaft as defined in claim 1, wherein the base body is an aluminum profile.

3. The heald shaft as defined in claim 1, wherein the base body is a single-piece component.

4. The heald shaft as defined in claim 1, wherein the stiffening bodies are of a carbon fiber material.

5. The heald shaft as defined in claim 1, wherein each stiffening body adjoins at least one web along the entire width.

6. The heald shaft as defined in claim 1, wherein t the stiffening bodies are rectangular.

7. The heald shaft as defined in claim 1, wherein at least one of the chambers has an insertion slot whose opening direction is oriented perpendicularly to one of the side walls.

8. The heald shaft as defined in claim 1, wherein one of the chambers has an insertion slot whose opening direction is oriented parallel to the side walls.

9. A heald shaft for weaving machines, particulary for rapidly operating weaving machines, comprising:

an elongated base body formed as a hollow profile body and having two side walls which are interconnected by web' with the base body further having at least one first chamber and at least one second chamber, each being open at least at one side;

a first stiffening body occupying the entire width of the base body between the two sidewalls and being disposed in the first chamber, with the first stiffening body being glued at least at two sides to the base body;

a second stiffening body occupying the entire width of the base body between the two side walls and being disposed in the second chamber, with the second stiffening body being glued at least at two sides to the base body; and wherein at least one of the stiffening bodies has at least one wedge-shaped end.

10. The heald shaft as defined in claim 9, wherein a web adjoining the stiffening body is interrupted by a passage closed by the stiffening body; further, the remaining web ends are wedge-shaped, and the wedge-shaped end of the stiffening body is connected to the web ends.

11. A heald shaft for weaving machines, particularly for rapidly operating weaving machines, comprising:

an elongated extruded base body formed as a hollow profile body having two spaced side walls that are interconnected by at least one web to provide a plurality of chambers between the sidewalls, with at least a first of said chambers and a second of said chambers each being open at least at one side;

a first stiffening body disposed in the first chamber and occupying the entire width of the base body between the two side walls, with the second stiffening body being glued at least at two sides to the base body;

a second stiffening body disposed in the second chamber and occupying the entire width of the base body between the two side walls, with the second stiffening body being glued at least at two sides to the base body.

12. The heald shaft as defined in claim 11, wherein said first and second chambers are the upper most and lower most chambers, respectively, of the base body.

13. The heald shaft as defined in claim 11, wherein at least one of the first and second chambers is open on a side extending perpendicular to the sidewalls.

14. The heald shaft as defined in claim 13, wherein said first chamber is open along the entire length of the side extending perpendicular to the sidewalls.

15. The heald shaft as defined in claim 13, wherein said first chamber is closed at respective end regions of the side of the base body extending perpendicular to the sidewalls, and open there-between.

16. The heald shaft as defined in claim 12, wherein at least one of the first and second chambers is open on a side extending parallel to the sidewalls.

17. The heald shaft as defined in claim 16, wherein both of the first and second chambers are open on a side extending parallel to the sidewalls, with the respective sides opening in opposite directions.

18. The heald shaft as defined in claim 11, wherein each of said first and second stiffening bodies is glued to at least one web of said body.

19. The heald shaft as defined in claim 11, where the extruded base body is formed from aluminum.

* * * * *